US009032548B2

(12) United States Patent
Isobe

(10) Patent No.: US 9,032,548 B2
(45) Date of Patent: May 19, 2015

(54) VISOR ATTACHMENT MECHANISM IN HELMET

(75) Inventor: Eiji Isobe, Chiba (JP)

(73) Assignee: Shoei Co., Ltd., Tokyo (JP)

( * ) Notice: Subject to any disclaimer, the term of this patent is extended or adjusted under 35 U.S.C. 154(b) by 489 days.

(21) Appl. No.: 13/490,818

(22) Filed: Jun. 7, 2012

(65) Prior Publication Data

US 2013/0025015 A1 Jan. 31, 2013

(30) Foreign Application Priority Data

Jul. 28, 2011 (JP) ..... 2011-165060

(51) Int. Cl.
*A42B 3/22* (2006.01)

(52) U.S. Cl.
CPC ..... *A42B 3/222* (2013.01); *A42B 3/226* (2013.01)

(58) Field of Classification Search
CPC ..... A42B 1/064; A42B 3/0406; A42B 3/22; A42B 3/221; A42B 3/222; A42B 3/223; A42B 3/225
USPC ..... 2/6.5, 15
See application file for complete search history.

(56) References Cited

U.S. PATENT DOCUMENTS

| | | | | |
|---|---|---|---|---|
| 3,495,273 | A * | 2/1970 | Aileo | 2/6.4 |
| 5,177,816 | A * | 1/1993 | Schmidt et al. | 2/424 |
| 2010/0064406 | A1 | 3/2010 | Lee | |
| 2011/0067158 | A1 * | 3/2011 | Lee | 2/15 |

FOREIGN PATENT DOCUMENTS

EP 1 393 642 A1 9/2002

* cited by examiner

*Primary Examiner* — Danny Worrell
*Assistant Examiner* — Khaled Annis
(74) *Attorney, Agent, or Firm* — Smith Gambrell & Russell LLP

(57) ABSTRACT

In this invention, a visor is configured to be inserted into a slit of a movable plate. One of an engaging projecting portion and an engaging concave portion is provided on the visor, and the other is provided on the movable plate. When the visor pivots in a first direction about the engaging projecting portion, a concave corner portion of the visor comes into contact with a first position regulating portion of the movable plate, thereby impeding the pivotal movement of the visor. When the visor pivots in a second direction, the outer wall surface of the visor comes into contact with wall portions of the movable plate, thereby impeding the pivotal movement of the visor.

17 Claims, 10 Drawing Sheets

VISOR ATTACHMENT MECHANISM IN HELMET

TECHNICAL FIELD

The present invention relates to a visor attachment mechanism in a helmet including a head protecting body having a window opening formed in a front surface, and a visor attached to the head protecting body to be movable forward and backward with respect to the head protecting body so as to at least partially open/close the window opening, the visor attachment mechanism further including a movable plate attached to the head protecting body to be movable forward and backward so as to indirectly attach the visor to the head protecting body via the movable plate, a slit provided in the movable plate to extend substantially in a planar direction of the movable plate so as to receive a region including one of a left end and a right end of the visor and a vicinity thereof, and a removal preventing means for preventing the region including the end of the visor and the vicinity thereof from being removed from the slit.

BACKGROUND OF THE INVENTION

A visor attachment mechanism in a helmet having the above-described structure has conventionally been known, as disclosed in U.S. Patent Application Publication No. 2010/0064406. In the visor attachment mechanism in a helmet disclosed in U.S. Patent Application Publication No. 2010/0064406 (to be referred to as "the visor attachment mechanism of the patent literature" hereinafter), the removal preventing means includes engaging projecting portions that have a substantially semicylindrical shape fallen down sideways and jut out in the regions of the left and right ends of the visor and the vicinities thereof, and a pair of left and right visor attachment portions provided on the movable plate so as to insert and attach the regions including the left and right ends of the visor and the vicinities thereof to the movable plate. The engaging projecting portions in the regions of the ends of the visor and the vicinities thereof, which are inserted into the visor attachment portions, are prevented by the click function of the engaging projecting portions and the visor attachment portions from being removed from the visor attachment portions.

In the visor attachment mechanism of the patent literature, the regions of the left and right ends of the visor and the vicinities thereof are prevented by the click function of the engaging projecting portions that jut out in the regions of the ends and the vicinities thereof and the pair of left and right visor attachment portions from being removed from the pair of left and right visor attachment portions. Hence, when the attachment mechanism of the engaging projecting portions to the visor attachment portions is designed to weaken the click function, the regions of the ends of the visor and the vicinities thereof can easily be attached to and detached from the visor attachment portions. In this case, however, the regions of the ends of the visor and the vicinities thereof are readily removed from the visor attachment portions accidentally. Conversely, when the attachment mechanism of the engaging projecting portions to the visor attachment portions is designed to enhance the click function, the regions of the ends of the visor and the vicinities thereof are hardly removed from the visor attachment portions accidentally. In this case, however, the regions of the ends of the visor and the vicinities thereof are hard to attach to and detach from the visor attachment portions.

On the other hand, when the attachment mechanism of the engaging projecting portions to the visor attachment portions is designed to obtain a click function with an appropriate strength, the regions of the ends of the visor and the vicinities thereof can relatively easily be attached to and detached from the visor attachment portions. Additionally, in this case, accidental removal of the regions of the ends of the visor and the vicinities thereof from the visor attachment portions is relatively rare. However, to adjust the click function to an appropriate strength, it is necessary to increase the accuracy of the manufacturing process of the regions of the ends of the visor and the vicinities thereof and the movable plate, and the size adjustment process of the regions of the ends of the visor and the vicinities thereof and the movable plate. In this case, it is therefore difficult to mass-produce the visor attachment mechanism.

SUMMARY OF THE INVENTION

The present invention is aimed at properly solving the above-described problems of the visor attachment mechanism of the patent literature using a relatively simple arrangement.

The present invention is directed to a visor attachment mechanism in a helmet including a head protecting body having a window opening formed in a front surface, and a visor attached to the head protecting body to be movable forward and backward with respect to the head protecting body so as to at least partially open/close the window opening, the visor attachment mechanism further including a movable plate attached to the head protecting body to be movable forward and backward so as to indirectly attach the visor to the head protecting body via the movable plate, a slit provided in the movable plate to extend substantially in a planar direction of the movable plate so as to receive a region including one of a left end and a right end of the visor and a vicinity thereof, and removal preventing means for preventing the region including the end of the visor and the vicinity thereof from being removed from the slit. In the visor attachment mechanism, the removal preventing means comprises first removal preventing means and second removal preventing means. The first removal preventing means comprises an engaging projecting portion provided on one of the movable plate and the region including an end of the visor and the vicinity thereof so as to project in a direction substantially perpendicular to the planar direction of one of the visor and the movable plate, and an engaging concave portion provided in one of the movable plate and the region including the end of the visor and the vicinity thereof so as to engage with the engaging projecting portion when the region including the end of the visor and the vicinity thereof is inserted into the slit. The second removal preventing means comprises a concave corner portion which is provided in the region including the end and the vicinity thereof on a side of a center line of the visor out of the removal preventing projecting portion by providing a removal preventing projecting portion in the region including the end of the visor and the vicinity thereof such that the removal preventing projecting portion extends substantially in a planar direction in the region including the end of the visor and the vicinity thereof a first position regulating portion provided on the movable plate to come into contact with the concave corner portion and impede pivotal movement in a first direction out of the pivotal movement of the visor with respect to the movable plate about one of the engaging projecting portion and the engaging concave portion, and a second position regulating portion provided on the movable plate to come into contact with the region including the end of the visor and the vicinity thereof (in particular, outer wall surfaces such as an upper outer wall surface and an outer wall surface on the distal end side) and impede pivotal movement in a second direction out of the pivotal movement of the visor.

According to the present invention having the above-described arrangement, the region including the end of the visor and the vicinity thereof can relatively easily be attached to the movable plate and relatively easily be detached from the movable plate. In addition, the region including the end of the visor and the vicinity thereof is relatively hardly removed from the movable plate accidentally. Especially, since not only the first removal preventing means but also the second removal preventing means whose arrangement is largely different from that of the first removal preventing means are provided, the region including the end of the visor and the vicinity thereof can relatively reliably be attached to the movable plate. However, it is not particularly necessary to accurately perform the manufacturing process of the region of the end of the visor and the vicinity thereof and the movable plate, and the size adjustment process of the region of the end of the visor and the vicinity thereof and the movable plate.

In the present invention, the helmet can be a full-face-type helmet. In the present invention, the visor is preferably a sun visor. In the present invention, the movable plate is preferably attached to the head protecting body via axial support means so as to pivot forward and backward. In the present invention, the engaging concave portion is preferably a through hole. In the present invention, the engaging projecting portion is preferably provided in the region including the end of the visor and the vicinity thereof, and the engaging concave portion is preferably provided in the movable plate.

Note that according to the first aspect of the present invention, the visor attachment mechanism is configured such that after the region including the end of the visor and the vicinity thereof is inserted midway through the slit of the movable plate until a region including the concave corner portion and a vicinity thereof comes into contact with a region including the first position regulating portion and a vicinity thereof, the region including the end of the visor and the vicinity thereof is made to pivot forward about the region including the first position regulating portion and the vicinity thereof, which is in contact with the region including the concave corner portion and the vicinity thereof and serves as a pivotal support, thereby storing the region including the end of the visor and the vicinity thereof in the slit of the movable plate. The visor attachment mechanism is also configured such that the region including the end of the visor and the vicinity thereof is made to pivot backward about the region including the first position regulating portion and the vicinity thereof, which is in contact with the region including the concave corner portion and the vicinity thereof and serves as a pivotal support, thereby extracting the region including the end of the visor and the vicinity thereof midway from the slit of the movable plate and then removing the region including the end of the visor and the vicinity thereof midway from the slit of the movable plate. According to the first aspect of the present invention, it is possible to quickly and reliably attach the region including the end of the visor and the vicinity thereof to the movable plate and also quickly and reliably extract the region including the end of the visor and the vicinity thereof from the movable plate.

According to the second aspect of the present invention, the movable plate comprises, around the slit, an upper wall portion, a first side wall portion located on a side opposite to an insertion side of the visor to the slit, a lower wall portion, and a second side wall portion located in a region including a lower end of the visor and a vicinity thereof on the insertion side to the slit. The first position regulating portion is formed from a region including an upper end of the second side wall portion and a vicinity thereof, and the second position regulating portion is formed from the upper wall portion and/or the first side wall portion. According to the second aspect of the present invention, although the slit to receive the region including the end of the visor and the vicinity thereof is provided in the movable plate so as to extend substantially in the planar direction of the movable plate, the strength of the movable plate relatively hardly lowers, and the structure is relatively simple.

According to the third aspect of the present invention, the visor attachment mechanism further comprises a bent portion formed by a corner portion of an outer wall portion of the movable plate, and the bent portion is configured to tilt outward from a proximal end of the bent portion to a distal end of the bent portion at least on an inner surface of the outer wall portion, and the engaging concave portion is configured to relatively and at least partially rise from the engaging projecting portion when the bent portion is raised outward. According to the third aspect of the present invention, it is possible to relatively easily and relatively reliably perform an operation of relatively separating the engaging projecting portion engaging with the engaging concave portion from the engaging concave portion. In this case, preferably, the bent portion has a substantially triangular shape, and a thickness of the bent portion gradually decreases from the proximal end to the distal end substantially continuously. This structure allows to more easily and reliably perform the separating operation by a relatively simple structure.

According to the fourth aspect of the present invention, an angle made by an inner surface of the bent portion and an outer surface of the visor preferably falls within a range of 11.5° to 22.5° (more preferably, 12° to 22°). An area of the inner surface of the bent portion also preferably falls within a range of 12 to 24 $mm^2$ (more preferably, 14 to 22 $mm^2$). A distance between an inner surface of the bent portion and an inner end of the distal end of the bent portion rising from the inner surface also preferably falls within a range of 0.8 to 1.6 mm (more preferably, 0.9 to 1.5 mm). According to the fourth aspect of the present invention, the third aspect of the present invention can more effectively take effect.

According to the fifth aspect of the present invention, the visor attachment mechanism is configured to move the movable plate forward and backward via a wire connection mechanism by moving an operation knob of an operation knob attachment mechanism forward and backward, the operation knob attachment mechanism comprises an attachment base attached to an outer surface of the head protecting body, a longitudinal guide member attached to an inner surface of the attachment base, and the operation knob attached to the longitudinal guide member to be movable forward and backward, the operation knob comprises a base portion and a knob main body formed into a roof shape on the base portion, and the operation knob is attached to the longitudinal guide member to be slidable forward and backward with respect to the longitudinal guide member by relatively inserting the longitudinal guide member between the base portion of the operation knob and the knob main body of the operation knob. According to the fifth aspect of the present invention, the forward and backward movement of the operation knob of the operation knob attachment mechanism can relatively easily and relatively reliably be performed by a relatively simple structure. In this case, the operation knob attachment mechanism preferably further comprises a wire holding member attached to the attachment base so as to locate on an inner surface of the longitudinal guide member, the wire holding member being configured to hold a position of a wire sheath portion of the wire connection mechanism. This structure allows to relatively easily and relatively reliably perform position holding of the wire sheath portion of the wire of the wire connection mechanism by a relatively simple structure. In addition, preferably, the operation knob further comprises an engaging projecting portion, and the longitudinal guide member comprises a first engaging concave portion that engages with the engaging projecting portion by click when the operation knob moves backward, and a second engaging concave portion that engages with the engaging projecting portion by click when the operation knob moves forward. This structure allows to more easily and more reliably move the operation knob of the operation knob attachment mechanism forward and backward by a relatively simple structure.

The above, and other, objects, features and advantages of the present invention will become readily apparent from the following detailed description thereof which is to be read in connection with the accompanying drawings.

DETAILED DESCRIPTION OF THE INVENTION

An embodiment in which the present invention is applied to a full-face-type helmet will now be described with reference to the accompanying drawings in "1. Schematic Arrangement of Helmet as a Whole", "2. Arrangement of Visor Attachment Mechanism", "3. Arrangement of Operation Knob Attachment Mechanism", "4. Visor Attachment/Detachment Method" and "5. Visor Raising/Lowering Method".

1. Schematic Arrangement of Helmet as a Whole

Figure 1:
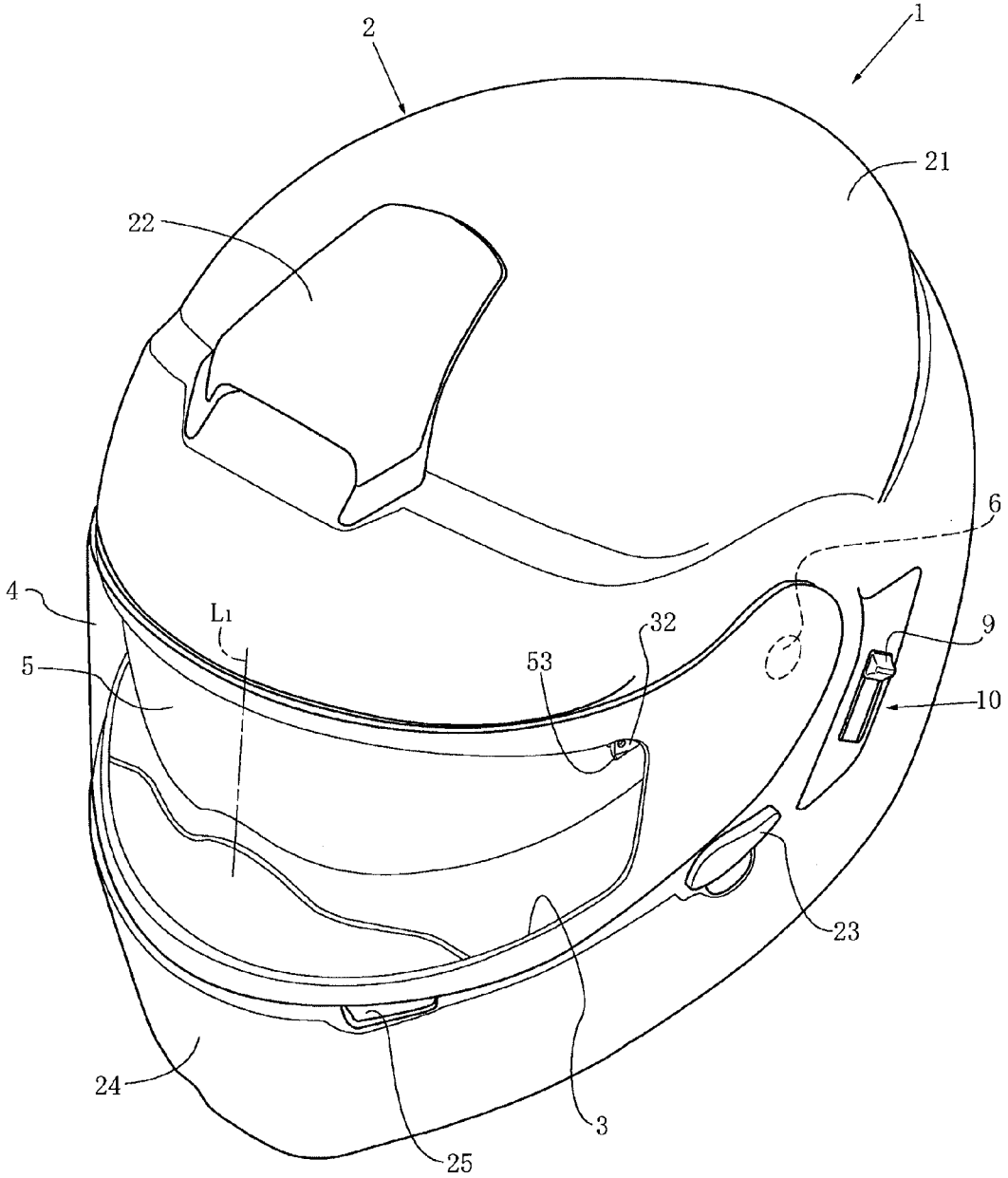
FIG. 1 is a perspective view of an entire helmet in a visor down state according to an embodiment in which the present invention is applied to a full-face-type helmet.
Figure 2:
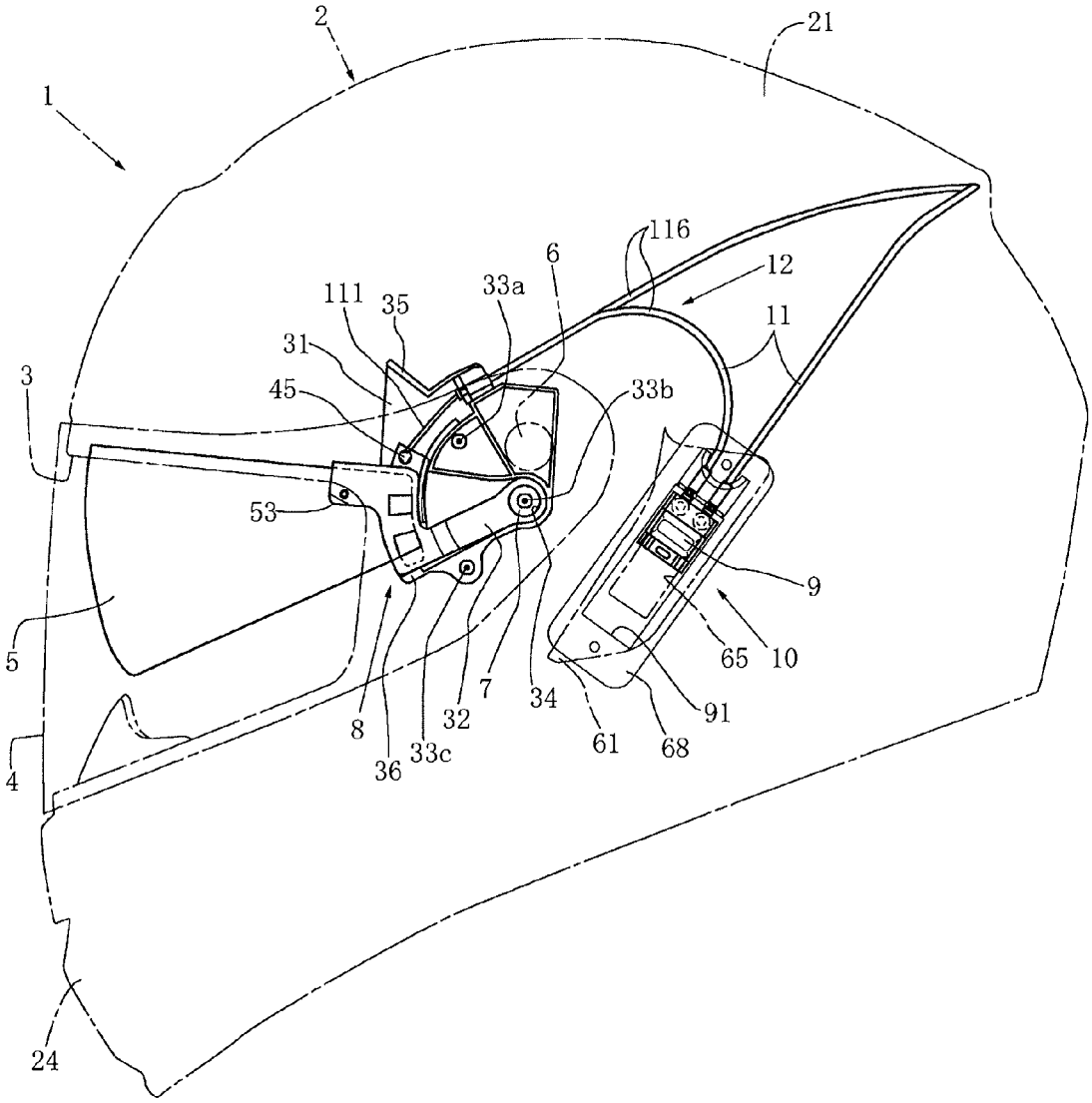
FIG. 2 is a left side view of the entire helmet shown in FIG. 1.
Figure 3:
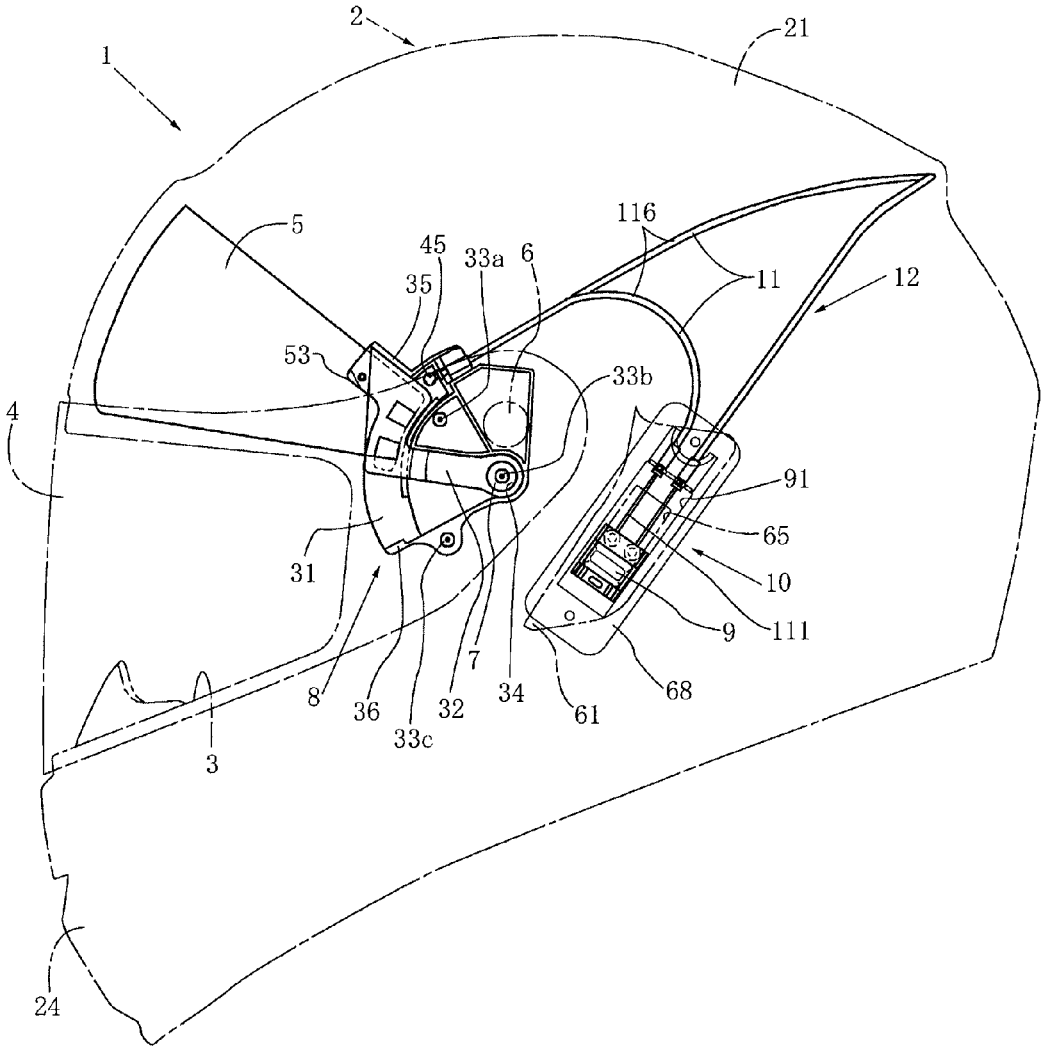
FIG. 3 is a left side view of the entire helmet shown in FIG. 1 in a visor up state.

As shown in FIGS. 1 to 3, a full-face-type helmet 1 includes a full-face-type cap-like body (in other words, head protecting body) 2 to be put on the head of a helmet wearer such as a motorbike rider, a shield plate 4 capable of opening/closing, from outside of a window opening 3, the substantially entire window opening 3 that is formed in the front surface of the head protecting body 2 so as to face the portion between the forehead and chin of the helmet wearer (that is, the substantially central portion of the face), a visor (in other words, sun visor) 5 capable of opening/closing, from inside of the window opening 3, the substantially upper half portion of the window opening 3 that faces the portion between the forehead (more specifically, the substantially intermediate portion of the forehead in the vertical direction) and the nose (more specifically, the substantially intermediate portion of the nose in the vertical direction) of the helmet wearer, and a pair of left and right chin straps (not shown) attached to the inner surface of the head protecting body 2.

The shield plate 4 shown in FIGS. 1 to 3 can be made of a hard transparent or semitransparent material having flexibility such as polycarbonate or another hard synthetic resin, as is known. The shield plate 4 is attached to the head protecting body 2 via a pair of left and right attachment shaft portions 6 serving as pivotal support means on the left and right sides of the head protecting body 2 so as to pivot forward and backward. The shield plate 4 closes the window opening 3 at its backward position (that is, down position) and opens the window opening 3 at its forward position (that is, up position).

The visor 5 shown in FIGS. 1 to 6 can be made of a hard semitransparent material having flexibility and a light-shielding function such as polycarbonate or another hard synthetic resin, as is known. The visor 5 is attached to the head protecting body 2 via a pair of left and right attachment shaft portions 7 serving as pivotal support means on the left and right sides of the head protecting body 2 so as to pivot forward and backward. The visor 5 closes the substantially upside half of the window opening 3 at its forward position (that is, down position) and opens the window opening 3 at its backward position (that is, up position). Note that the arrangement of a visor attachment mechanism 8 will be described later in detail in "2. Arrangement of Visor Attachment Mechanism". The arrangement of an operation knob attachment mechanism 10 configured to attach, to the cap-like body 2, an operation knob 9 to be operated to make the visor 5 pivot forward or backward will be described later in detail in "3. Arrangement of Operation Knob Attachment Mechanism". The arrangement of a wire connection mechanism 12 that connects the visor attachment mechanism 8 to the operation knob attachment mechanism 10 via a wire 11 that is flexible filaments will be described later in detail in "2. Arrangement of Visor Attachment Mechanism" and "3. Arrangement of Operation Knob Attachment Mechanism".

The head protecting body 2 shown in FIGS. 1 to 3 can include a full-face-type outer shell 21 that constitutes the outer wall of the head protecting body 2, a rim member (not shown) having a substantially U-shaped section (however, having a substantially E-shaped section at the upper end of the window opening 3) and attached to substantially all around the end of the outer shell 21 by adhesion or the like, and a backing member (not shown) attached in contact with the inner surface of the outer shell 21 by adhesion or the like, as is known. Note that the outer shell 21 can be made of a composite material formed by wholly or partially lining the inner surface of a strong shell main body made of FRP or another hard synthetic resin with a flexible sheet such as nonwoven fabric, as is known. The rim member having the substantially U-shaped section can be made of foamed vinyl chloride, synthetic rubber, or another soft synthetic resin, as is known. The rim member having the substantially E-shaped section can be made of synthetic rubber or another highly flexible elastic material, as is known.

The backing member can include a shock absorbing liner attached to the inner surface of the outer shell 21 shown in FIGS. 1 to 3 by adhesion or the like, and a block-shaped interior pad and a backing cover which are sequentially attached to substantially cover the inner surface of the shock absorbing liner, as is known. The shock absorbing liner can be made of a material having appropriate rigidity and plasticity such as foamed polystyrene or another synthetic resin, as is known. The block-shaped interior pad can be formed from one or a plurality of highly flexible elastic materials such as urethane foam or another synthetic resin, and a fabric such as bag-shaped porous nonwoven fabric that covers the inner and outer surfaces of the elastic material, as is known. The backing cover can be made of porous nonwoven fabric whose surface facing the shock absorbing liner is laminated with a layer of a highly flexible elastic material such as urethane foam or another synthetic resin, as is known. An air vent forming member 22 for forehead is attached to the outer surface of the head protecting body 2 at the forehead portion, as shown in FIG. 1. A stopper 23 for regulating the backward position of the shield plate 4 is provided on the left side of the outer face of the head protecting body 2. Various kinds of air vents (not shown) are formed in a chin cover 24 of the head protecting body 2. Note that reference numeral 25 in FIG. 1 denotes a finger hook on which the helmet wearer puts a finger when making the shield plate 4 pivot forward or backward.

2. Arrangement of Visor Attachment Mechanism

A pair of left and right visor attachment mechanisms 8 formed to be bilaterally symmetrical to each other are disposed on the left and right sides of the outer shell 21 to attach the left and right ends of the visor 5 to the outer shell 21, respectively, as shown in FIGS. 2 to 6. The pair of left and right visor attachment mechanisms 8 are bilaterally symmetrical to each other. Hence, the visor attachment mechanism 8 on the left side (in other words, on the right side of the helmet 1 when viewed from the front) will be described below in detail, and a description of the visor attachment mechanism 8 on the right side of the helmet 1 will appropriately be omitted.

As shown in FIGS. 2 to 6, the visor attachment mechanism 8 includes members described in (A) to (C):

(A) an attachment board 31 attached to the inner surface of the outer shell 21 by screws (not shown);

(B) a movable plate 32 pivotally supported by the attachment board 31 so as to be located between the outer shell 21 and the attachment board 31; and (C) the visor 5 having the region including the left end and the vicinity thereof detachably attached to the movable plate 32.

The attachment board 31 has threaded holes 33*a*, 33*b* and 33*c* to receive the screws. Note that the threaded hole 33*b* is formed substantially on the axis of the attachment shaft portion 7 serving as a pivotal support means. The attachment shaft portion 7 is fitted in an opening 34 formed in the movable plate 32. Hence, the movable plate 32 can pivot forward and backward both counterclockwise in FIG. 3 and clockwise in FIG. 2 about the attachment shaft portion 7 serving as the pivotal center. The attachment board 31 is also provided with a first stopper 35 capable of regulating the backward pivoting position of the movable plate 32, and a second stopper 36 capable of regulating the forward pivoting position of the movable plate 32. The movable plate 32 and the attachment board 31 can be made of a flexible hard material such as ABS resin or another synthetic resin.

Figure 4:
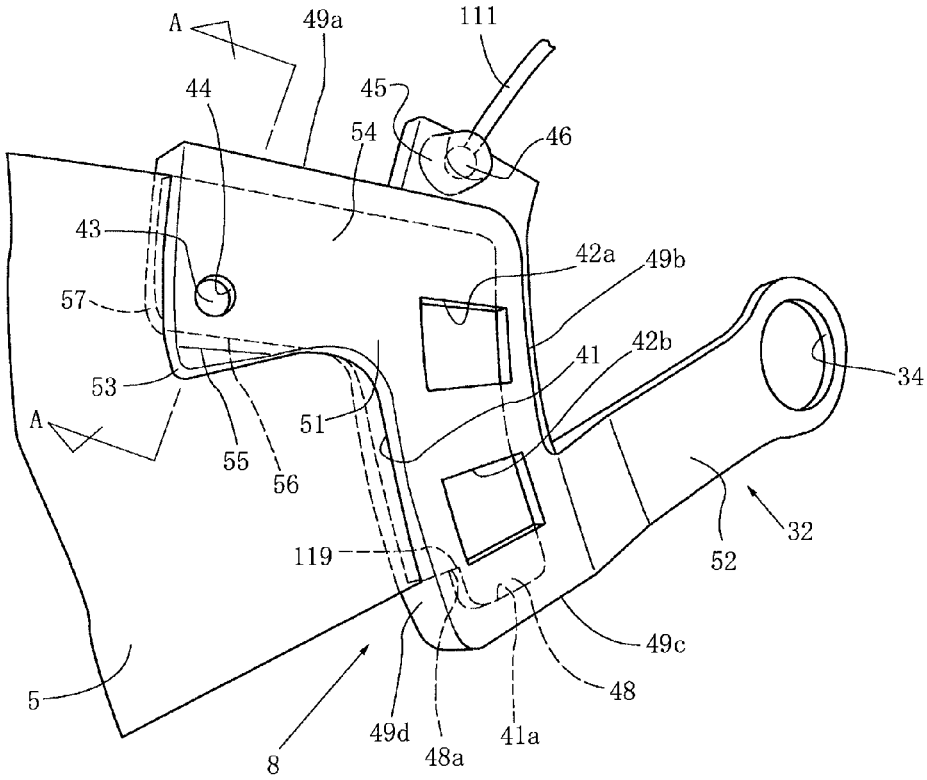
FIG. 4 is a perspective view of a visor attachment mechanism shown in FIG. 2 which is viewed from outside.

As shown in FIGS. 2 to 6, the region including the left end of the visor 5 and the vicinity thereof is attached and fixed to the movable plate 32. More specifically, a slit 41 having a substantially same shape as that of the region including the left end of the visor 5 and the vicinity thereof is formed in the movable plate 32 as a flat blind hole extending through the movable plate 32 in a substantially planar direction from the front end of the movable plate 32 to a substantially rear side of the movable plate 32. The slit 41 is formed into a substantially inverted L shape when viewed from outside so as to extend in a direction substantially perpendicular to the direction of thickness of the movable plate 32. The substantially inverted L-shaped slit 41 has, in the region including the lower end and the vicinity thereof, a removal preventing hole portion 41*a* whose lower end and side ends on the front and rear sides do not communicate with the exterior. The slit 41 has a pair of openings 42*a* and 42*b* facing to each other in a substantially vertical direction in a state in which the visor 5 pivots forward, as shown in FIG. 4. The visor 5 has, at its lower end in the region including the left end and the vicinity thereof, a removal preventing projecting portion 48 which can have a substantially same shape as that of the removal preventing hole portion 41*a* and is preferably substantially integrated with the other portion of the visor 5 to be substantially flush with the visor 5. In a state in which the visor 5 is attached to the movable plate 32, the removal preventing projecting portion 48 is stored in the removal preventing hole portion 41*a* preferably in a substantially fitted state. In other words, the movable plate 32 includes, around the slit 41, an upper wall portion 49*a*, a side wall portion 49*b* on the rear side located on a side opposite to the insertion side of the visor 5 to the slit 41, a lower wall portion 49*c*, and a side wall portion 49*d* on the inlet side located in the region including the lower end and the vicinity thereof on the insertion side of the visor 5 to the slit 41.

Figure 5:
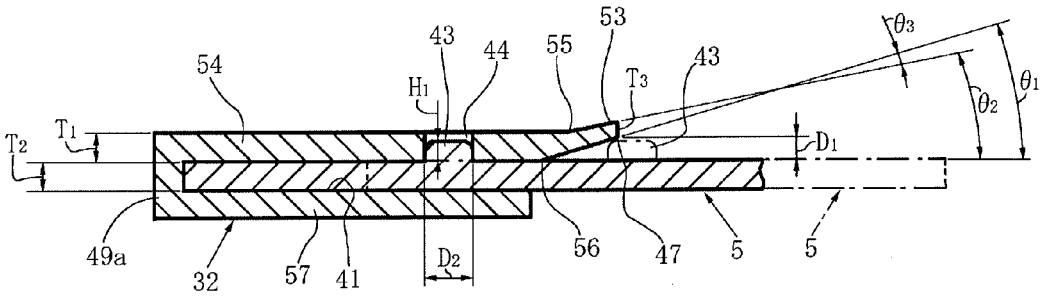
FIG. 5 is a sectional view taken along a line A-A in FIG. 4.

As shown in FIGS. 2 to 6, the movable plate 32 has an engaging opening 44 having, for example, a substantially circular shape and serving as an engaging concave portion capable of engaging with an engaging projecting portion 43 having, for example, a substantially cylindrical shape and provided on the visor 5. Note that the engaging opening 44 (in other words, engaging projecting portion 43) is preferably provided apart from the removal preventing hole portion 41*a* (in other words, removal preventing projecting portion 48) so as to face the removal preventing hole portion 41*a* on a movable plate main body 51 of the movable plate 32. The movable plate 32 also has, in, for example, the region including the upper end and the vicinity thereof, an engaging projecting portion 45 having an engaging hole on its inner surface. A connection spherical end 46 serving as the connection convex portion of the wire 11 of the connection mechanism 12 engages with the engaging hole serving as a connection concave portion, thereby coupling the spherical end 46 with the movable plate 32. The movable plate 32 also includes the movable plate main body 51 being a size larger than the substantially inverted L-shaped slit 41, and an attachment arm portion 52 integrated with the movable plate main body 51 and extending from the movable plate main body 51 substantially to the rear side. The movable plate main body 51 has the slit 41, the hole portion 41*a*, the openings 42*a* and 42*b*, the opening 44, the projecting portion 45, and a bent portion 53 to be described later. The pivotal support opening 34 is formed in the region including the trailing edge of the attachment arm portion 52 and the vicinity thereof. Note that the distal end of the engaging projecting portion 43 of the visor 5 is formed into a chamfered shape so as to be rounded, as shown in FIG. 5.

Figure 6:
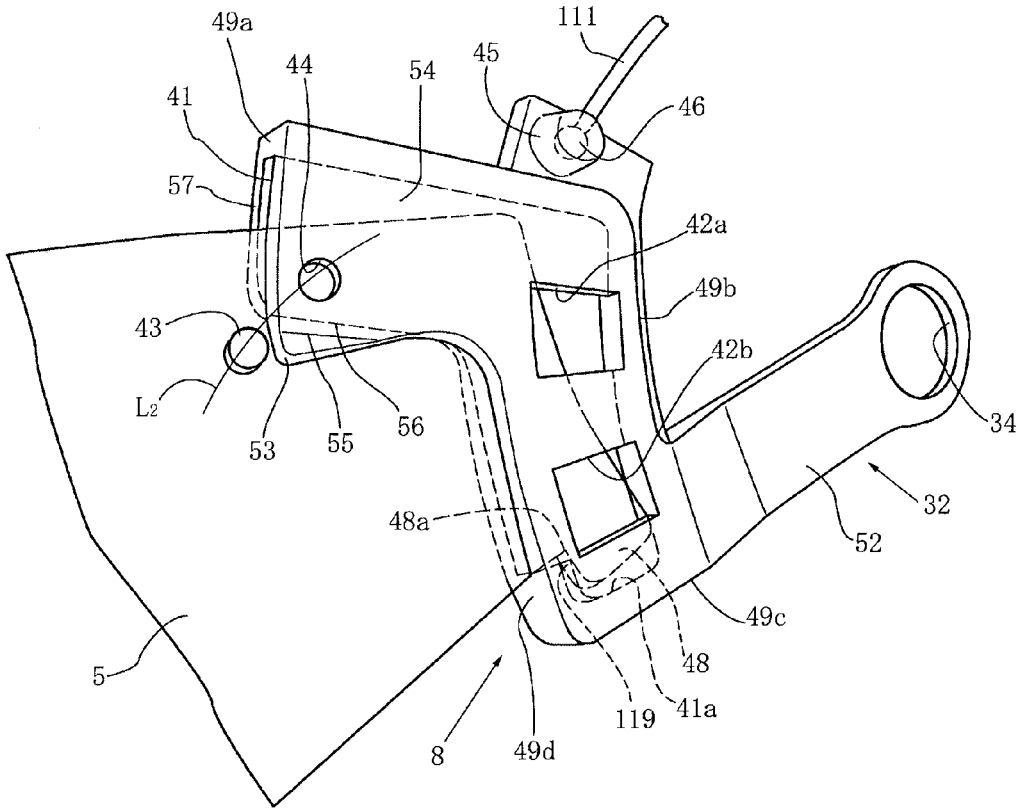
FIG. 6 is a perspective view of the visor attachment mechanism shown in FIG. 4 which is viewed from outside during the process of attaching or detaching the visor.

A substantially triangular corner portion provided at the front end on the lower end (in other words, corner portion) out of an outer wall portion 54 (the outer wall portion 54 opposes an inner wall portion 57 via the slit 41) of the movable plate main body 51 is bent outward to form the substantially triangular bent portion 53, as shown in FIGS. 4 to 6. As for the degree of bending (in other words, the angle with respect to the outer surface of the visor 5), an angle $\theta_1$ of the inner surface of the bent portion 53 is about 17°, and an angle $\theta_2$ of the outer surface of the bent portion 53 is about 11°. Hence, an angle $\theta_3$ made by the outer and inner surfaces of the bent portion 53 is about 6°. The bent portion 53 is substantially continuously tapered from lines 55 and 56 toward the distal end. Note that referring to FIGS. 4 to 6, the line 55 indicates the boundary between the bent portion 53 and the portion other than the bent portion 53 on the outer surface of the movable plate main body 51. In addition, the line 56 indicates the boundary between the bent portion 53 and the portion other than the bent portion 53 on the inner surface of the movable plate main body 51.

An average thickness $T_1$ of the front wall portion 54 (in other words, the thickness of the proximal end of the bent portion 53) and an average thickness $T_2$ of the visor 5 shown in FIGS. 2 to 6 are about 1.5 mm. On the other hand, a thickness $T_3$ of the distal end of the bent portion 53 in a direction substantially perpendicular to the visor 5 is about 0.8 mm. Hence, the ratio of the thickness of the distal end of the bent portion 53 to the average thickness of the front wall portion 54 (in other words, the thickness of the proximal end of the bent portion 53) is about 1.9. The thickness of the bent portion 53 preferably gradually decreases from the proximal end to the distal end substantially continuously. Note that the area of the outer surface of the bent portion 53 (in other words, the area on the bending side) is about 6.6 $mm^2$. The area of the inner surface of the bent portion 53 (in other words, the area on the side opposite to the bending side) is about 18 $mm^2$. The height and diameter of the engaging projecting portion 43 of the visor 5 are about 1 mm and about 2.5 mm, respectively. An inner end 47 of the distal end of the bent portion 53 is spaced apart from the inner surface of the proximal end of the bent portion 53 by about 1.2 mm outward in a direction perpendicular to the inner surface because the angle made by the inner surface of the bent portion 53 and the outer surface of the visor 5 is about 17°, as described above. In other words, a distance $D_1$ between the outer surface of the visor 5 and the inner end 47 rising outward from it is about 1.2 mm. Hence, the height of the engaging projecting portion 43 is smaller than the rise amount (that is, about 1.2 mm) of the inner end of the distal end of the bent portion 53 by about 0.2 mm.

In the embodiment illustrated, the bent portion 53 is formed into a substantially triangular shape, as shown in FIGS. 4 to 6. However, the bent portion 53 need not always have the substantially triangular shape and may have another shape such as a substantially rectangular shape, a substantially pentagonal shape, a substantially semicircular shape, a substantially semielliptical shape, or a substantially elliptical shape. From the viewpoint of practicality, the preferable numerical value ranges of the portions when the present invention is applied to a helmet will generally be listed in (a) to (l) (the helmet to which the present invention is applied preferably satisfies one or a plurality of numerical value ranges out of the numerical value ranges described in (a) to (l), or all of them):

(a) the angle $\theta_1$ made by the inner surface of the bent portion 53 and the outer surface of the visor 5 falls within the range of 11.5° to 22.5° (more preferably, 12° to 22°);

(b) the angle $\theta_2$ made by the outer surface of the bent portion 53 and the outer surface of the visor 5 falls within the range of 7.5° to 15° (more preferably, 8.5° to 13.5°);

(c) the angle $\theta_3$ made by the inner surface of the bent portion 53 and the outer surface of the bent portion 53 (in other words, the value of (angle $\theta_1$-angle $\theta_2$)) falls within the range of 4° to 8° (more preferably, 4.5° to 7.5°);

(d) the average thickness $T_1$ of the front wall portion 54 (in other words, the thickness of the proximal end of the bent portion 53) and the average thickness $T_2$ of the visor 5 fall within the range of 1 to 2 mm (more preferably, 1.2 to 1.8 mm);

(e) the thickness $T_3$ of the distal end of the bent portion 53 falls within the range of 0.5 to 1.1 mm (more preferably, 0.6 to 1 mm);

(f) the ratio of the thickness $T_3$ of the distal end of the bent portion 53 to the average thickness $T_1$ of the front wall portion 54 (in other words, the thickness of the proximal end of the bent portion 53) falls within the range of 1.3 to 2.5 (more preferably, 1.5 to 2.3);

(g) the area of the outer surface of the bent portion 53 falls within the range of 4.5 to 9 $mm^2$ (more preferably, 5 to 8 $mm^2$);

(h) the area of the inner surface of the bent portion 53 falls within the range of 12 to 24 $mm^2$ (more preferably, 14 to 22 $mm^2$);

(i) a height $H_1$ of the engaging projecting portion 43 falls within the range of 0.7 to 1.3 mm (more preferably, 0.8 to 1.2 mm);

(j) a diameter $D_2$ of the engaging projecting portion 43 falls within the range of 1.6 to 3.2 mm (more preferably, 1.8 to 3 mm);

(k) the distance $D_1$ between the inner surface of the bent portion 53 and the inner end of the distal end of the bent portion 53 rising from it falls within the range of 0.8 to 1.6 mm (more preferably, 0.9 to 1.5 mm); and (l) a value obtained by subtracting the height $H_1$ described in (i) from the rising distance $D_1$ described in (k) falls within the range of 0.13 to 0.27 mm (more preferably, 0.15 to 0.25 mm).

The visor attachment mechanism 8 (including the visor 5) shown in FIGS. 2 to 6 can be stored between the outer shell 21 and the backing member, as shown in FIG. 3. To do this, the helmet 1 has a visor storage gap between the outer shell 21 and the backing member, as is known. The attachment board 31 stored in the visor storage gap is attached and fixed to the inner surface of the outer shell 21 by, for example, three screws threadably engaged into the threaded holes 33*a* to 33*c*. The movable plate 32 axially supported on the attachment board 31 by the attachment shaft portion 7 is also stored in the visor storage gap. The visor 5 whose pair of left and right ends are attached and fixed to the pair of left and right movable plates 32 can pivot forward and backward between the up position shown in FIG. 3 and the down position shown in FIG. 2. At the up position shown in FIG. 3, the visor 5 is stored in the visor storage gap.

3. Arrangement of Operation Knob Attachment Mechanism

As shown in FIGS. 1 to 3, the operation knob attachment mechanism 10 is disposed on the outer shell 21 at a position slightly on the rear side of the visor attachment mechanism 8 on the left side (in other words, at a position in the region including the left side surface of the helmet 1 and the vicinity thereof). The operation knob attachment mechanism 10 is configured to commonly make the movable plates (in other words, the pair of left and right movable plates) 32 of the pair of left and right visor attachment mechanisms 8 pivot forward and backward via the wire connection mechanism 12 by moving the operation knob 9 forward and backward.

As shown in FIGS. 1 to 3 and FIGS. 7 to 11, the operation knob attachment mechanism 10 includes members described in (A) to (D):

(A) an attachment base frame 61 serving as an attachment base attached to the outer surface of the outer shell 21 by a screw (not shown) serving as an attachment means or a fixing means;

(B) a longitudinal guide member 62 serving as a guide means attached to the inner surface of the attachment base frame 61;

(C) a longitudinal wire holding member 68 serving as a wire holding means attached to the attachment base frame 61 by the screw so as to be located on the inner surface of the guide member 62; and (D) the operation knob 9 serving as an operation means or an operation member attached to the guide member 62 so as to be movable forward and backward.

The attachment base frame 61 includes a longitudinal board portion 63, a longitudinal side plate portion 64 integrated with the front side end of the board portion 63 so as to extend toward the inside of the board portion 63, and an opening 65 formed in the board portion 63 to be longitudinal along the direction of length of the board portion 63. The attachment base frame 61 described in (A) and the wire holding member 68 described in (C) can be made of a flexible hard material, for example, a synthetic resin such as polypropylene. The wire holding member 68 described in (B) and the operation knob 9 described in (D) can be made of a flexible hard material, for example, a synthetic resin such as ABS resin.

Figure 7:
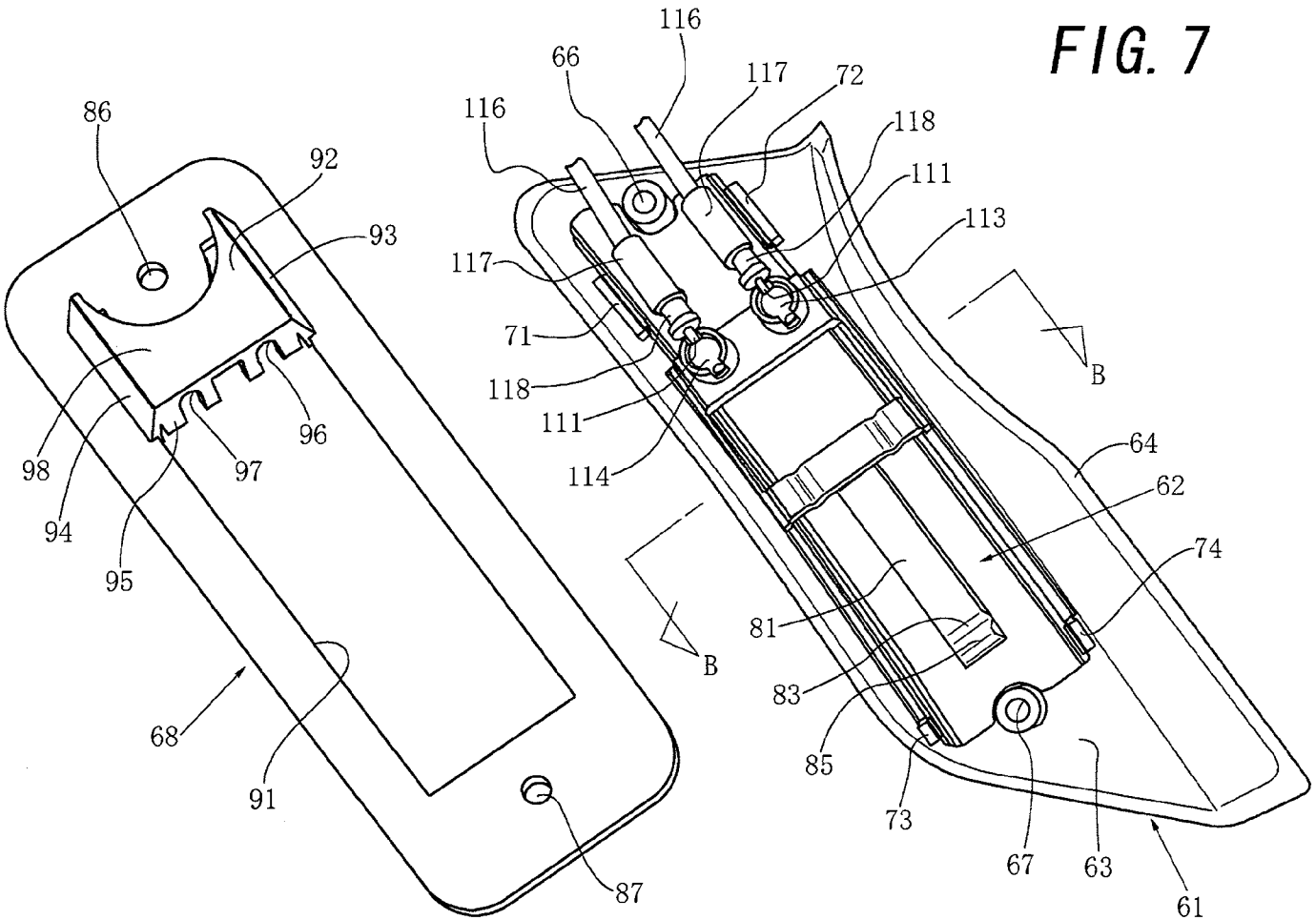
FIG. 7 is a perspective view of an operation knob attachment mechanism shown in FIG. 1 in the visor down state when viewed from inside with only a wire holding member being decomposed.
Figure 9:
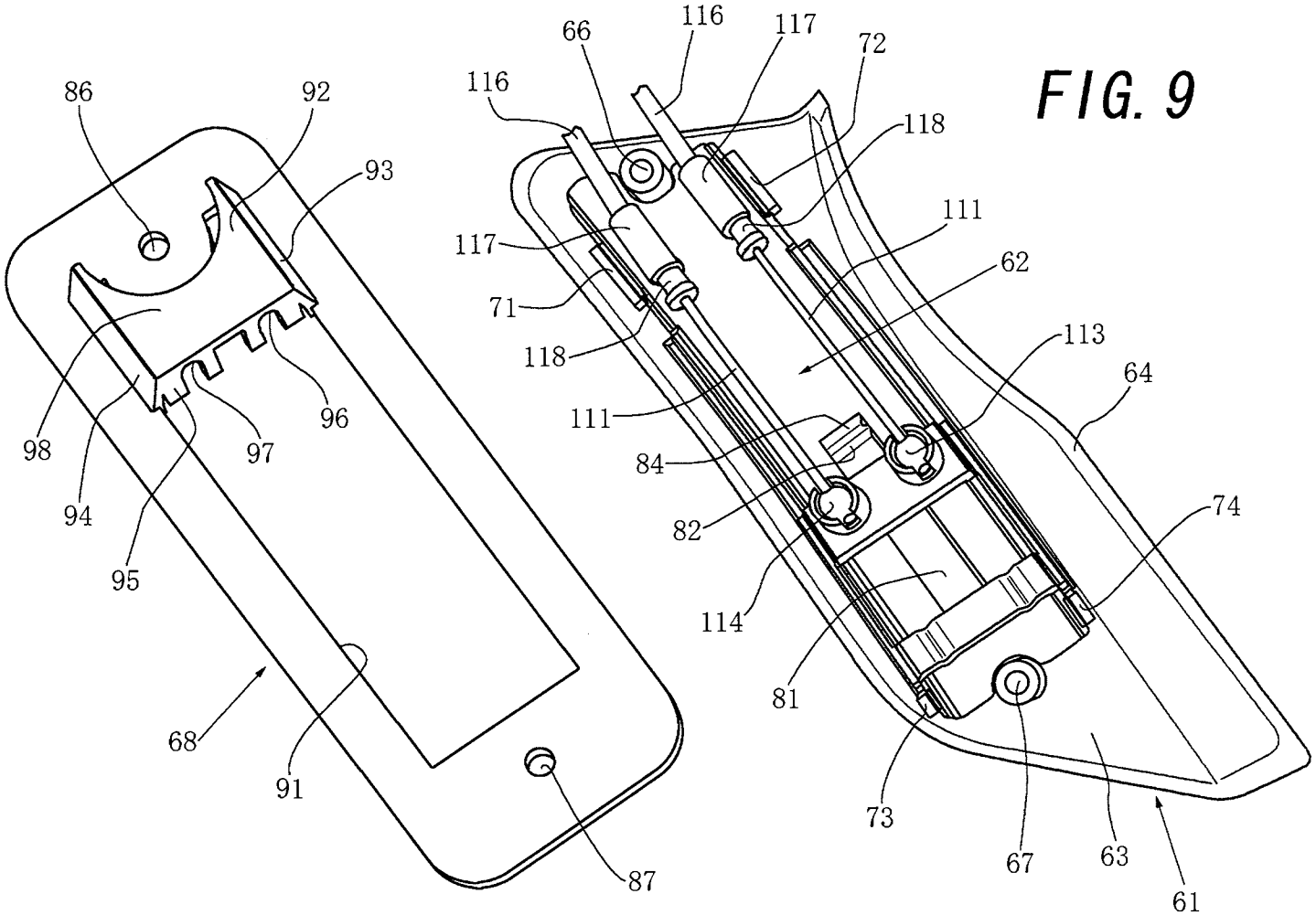
FIG. 9 is a perspective view of the operation knob attachment mechanism shown in FIG. 7 in the visor up state when viewed from inside.
Figure 10:
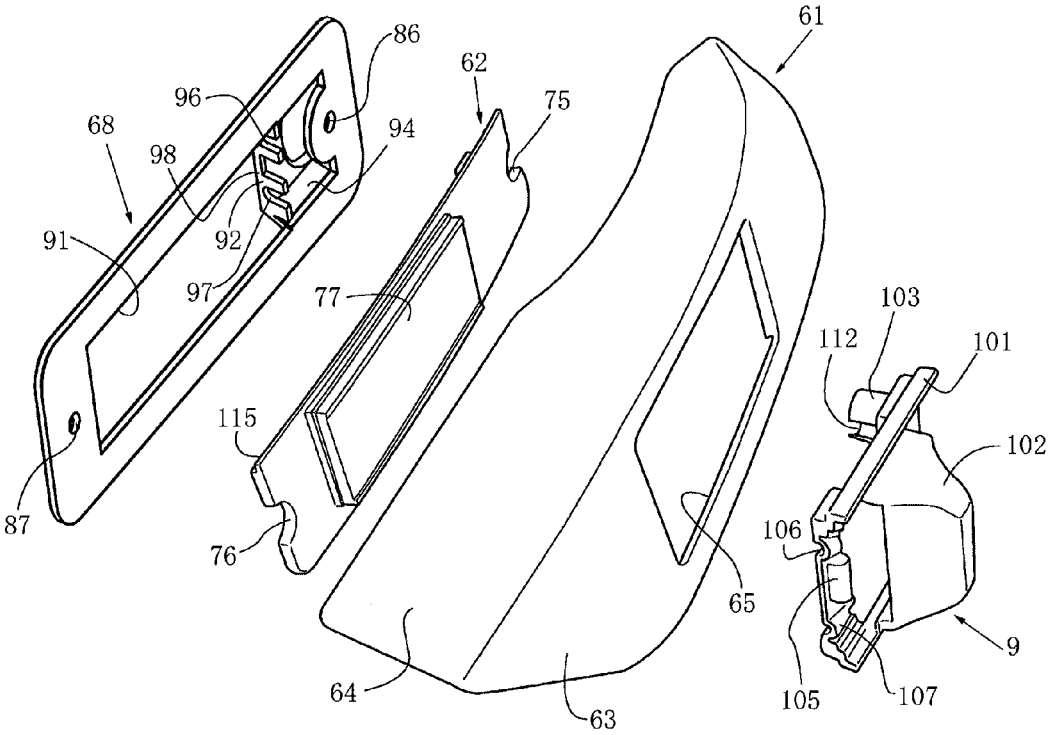
FIG. 10 is an exploded perspective view of the operation knob attachment mechanism shown in FIG. 7 when viewed from outside.
Figure 11:
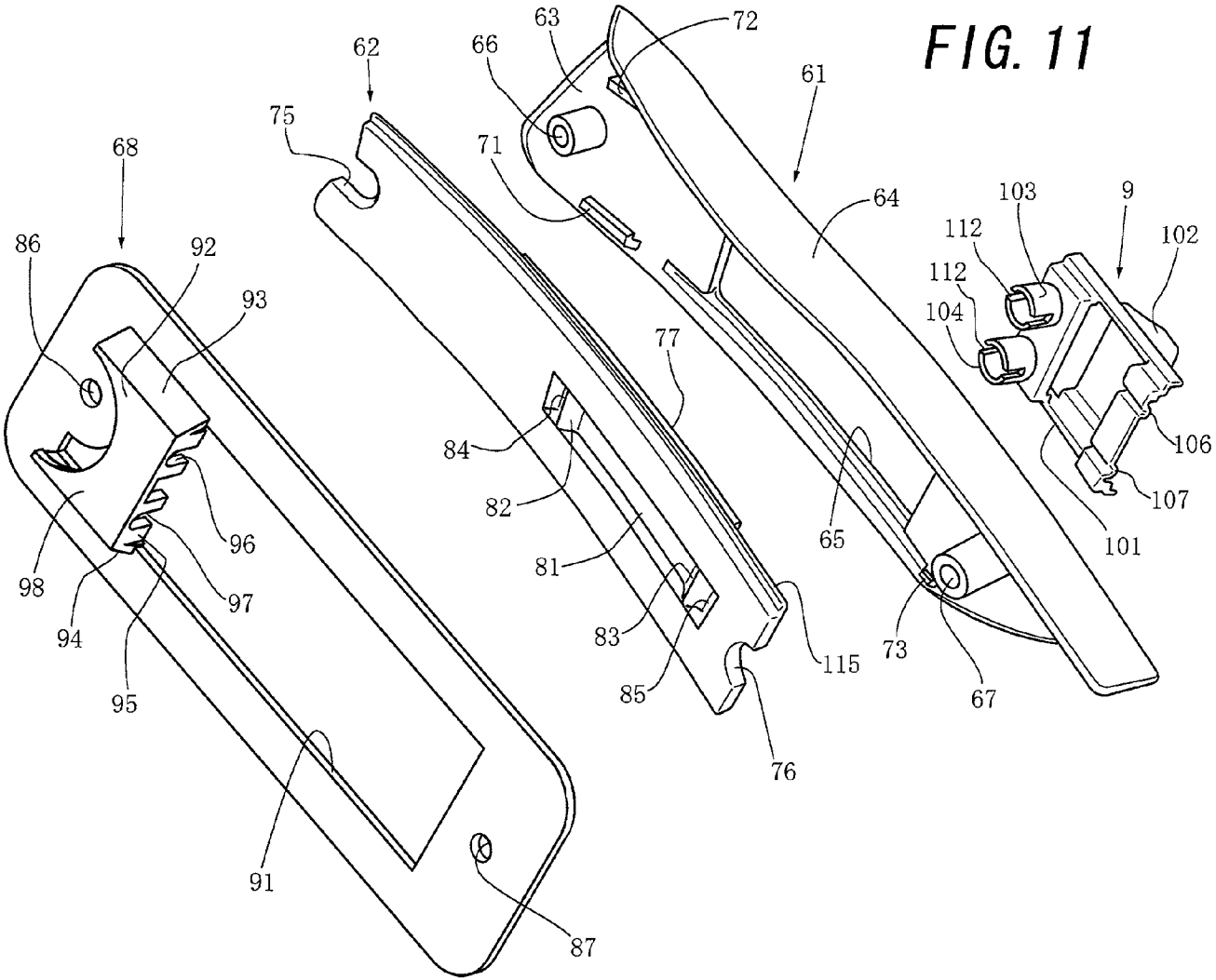
FIG. 11 is an exploded perspective view of the operation knob attachment mechanism shown in FIG. 7 when viewed from inside.

As shown in FIGS. 7, 9 and 11, the attachment base frame 61 has, on its inner surface, boss portions 66 and 67 that also serve as threaded holes and are provided in the region including one end in the direction of length of the attachment base frame 61 and the vicinity thereof and in the region including the other end and the vicinity thereof, respectively. The attachment base frame 61 has, on its inner surface, a pair of left and right relatively long engaging pawls 71 and 72 that are integrally formed in the regions including the left and right sides of the boss portion 66 and the vicinities thereof. The attachment base frame 61 also has, on its inner surface, a pair of left and right relatively short engaging pawls 73 and 74 that are integrally formed in the regions including the left and right sides of the boss portion 67 and the vicinities thereof.

As shown in FIGS. 7 and 9 to 11, the guide member 62 includes engaging concave portions 75 and 76 at the two ends in the direction of length of the guide member 62. The guide member 62 has, on its outer surface, a longitudinal guide thick portion 77 extending substantially along the direction of length of the guide member 62. The guide member 62 has, on its inner surface, a longitudinal concave portion 81 extending substantially along the direction of length. The longitudinal concave portion 81 includes projecting wall portions 82 and 83 formed in the regions including the two ends in the direction of length of the longitudinal concave portion 81 and the vicinities thereof. Hence, engaging concave portions 84 and 85 are formed between the projecting wall portions 82 and 83 and the two ends of the longitudinal concave portion 81, respectively.

As shown in FIGS. 7 and 9 to 11, the wire holding member 68 has screw insertion holes 86 and 87 in the regions including the two ends in the direction of length of the wire holding member 68 and the vicinities thereof. The wire holding member 68 has a longitudinal opening 91 extending substantially along the direction of length of the wire holding member 68. A wire receiving portion 92 projecting inward is provided in the region including the upper end of the wire holding member 68 and the vicinity thereof. The wire receiving portion 92 includes a substantially U-shaped projecting wall portion formed from projecting wall pieces 93 and 94 on the left and right sides and a projecting wall piece 95 formed substantially at the center so as to substantially face the longitudinal opening 91 in addition to a wire receiving portion main body 98 having a substantially flat plate shape. The projecting wall piece 95 has a pair of left and right wire engaging concave portions 96 and 97 that are provided adjacent to each other on the left and right sides.

The operation knob 9 includes a base portion 101, a knob main body 102 formed into a roof shape on the base portion 101, a pair of left and right engaging projecting portions 103 and 104 projecting from the inner surface of the base portion 101 and preferably having a substantially cylindrical shape, and an engaging projecting portion 105 projecting in the region including the trailing edge of the base portion 101 and the vicinity thereof and having a substantially semicylindrical shape preferably fallen down sideways. The base portion 101 can be a substantially rectangular frame and can preferably be integrated with the knob main body 102, the projecting portions 103 and 104 and the engaging projecting portion 105. A pair of left and right bent portions 106 and 107 projecting outward are formed in the region including the front end of the base portion 101 and the vicinity thereof so as to be located on the left and right sides of the engaging projecting portion 105. Hence, the engaging projecting portion 105 is elastically held with respect to the knob main body 102 and portions formed on the left and right sides of the base portion 101 so as to have an upright shape. Each of the pair of left and right fitting projecting portions 103 and 104 having a substantially cylindrical shape has a pair of front and rear slits 112 for a wire main body 111 of the wire 11.

A substantially longitudinal opening (not shown) is formed in the outer shell 21 to attach the operation knob attachment mechanism 10. Note that the longitudinal opening can have a substantially same shape as that of the opening 91 of the wire holding member 68 and can be provided at a substantially same position as that of the opening 91 of the wire holding member 68, as shown in FIGS. 2 and 3, in the attached state of the operation knob attachment mechanism 10 to the outer shell 21 shown in FIGS. 1 to 3. A screw insertion hole (not shown) is formed in the outer shell 21 in the region including the lower end of the longitudinal opening and the vicinity thereof. The screw insertion hole can have a position and size substantially corresponding to the screw insertion hole 87 of the wire holding member 68 in the state shown in FIGS. 2 and 3. A cut-shaped screw insertion concave portion (not shown), which can have a position and size substantially corresponding to the screw insertion hole 86 of the wire holding member 68 in the state shown in FIGS. 2 and 3, is provided at the upper end of the longitudinal opening.

To mount the operation knob attachment mechanism 10 on the outer shell 21 as shown in FIGS. 1 to 3, the mounting operation described in (a) to (c) is performed.

Figure 8:
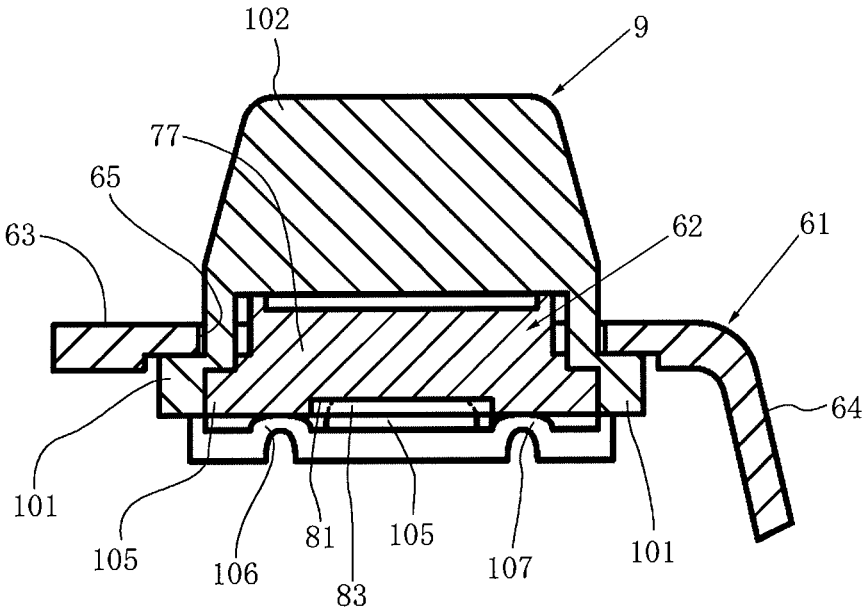
FIG. 8 is a sectional view taken along a line B-B in FIG. 7.

(a) First, the operation knob 9 is attached to the guide member 62. More specifically, the end of the guide member 62 on the side of the concave portion 75 or on the side of the concave portion 76 is inserted and fitted between the base portion 101 and the knob main body 102 of the operation knob 9, thereby attaching the knob main body 102 to the base portion 101. In this case, the operation knob 9 is attached to the guide member 62 so as to be slidable forward and backward substantially in the direction of length of the guide member 62, as shown in FIG. 8. At the end point of backward sliding (see FIG. 9) out of the above-described forward and backward sliding, the engaging projecting portion 105 of the operation knob 9 engages with the engaging concave portion 85 of the guide member 62. At the end point of forward sliding (see FIG. 7) out of the above-described forward and backward sliding, the engaging projecting portion 105 of the operation knob 9 engages with the engaging concave portion 84 of the guide member 62.

(b) Next, the operation knob 9 attached to the guide member 62 is inserted into the longitudinal opening 65 of the attachment base frame 61 from the inner surface side to the outer surface side. A pair of left and right guided rail portions 115 projecting on the left and right sides of the guide member 62 are moved substantially upward substantially in the direction of length of the guide member 62, thereby engaging the guided rail portions 115 with the pair of pair of left and right relatively long engaging pawls 71 and 72 of the attachment base frame 61. Then, the guide member 62 is simply pressed against the inner surface of the attachment base frame 61 to engage the pair of left and right guided rail portions 115 with the pair of left and right relatively short engaging pawls 73 and 74 using the elastic deformation of the engaging pawls 73 and 74 caused by flexibility. Note that the above-described engagement of the engaging pawls 71 to 74 allows the boss portions 66 and 67 of the attachment base frame 61 to engage with or fit in the concave portions 75 and 76 of the guide member 62, respectively. The guide member 62 (the operation knob 9 in turn) is thus properly attached to the attachment base frame 61.

(c) Next, the attachment base frame 61 (the assembly formed from the operation knob 9, the attachment base frame 61 and the guide member 62 in turn) is put to the outer surface of the outer shell 21 in the region including the longitudinal opening and the vicinity thereof. Simultaneously, the proximal end sides of the pair of left and right wires 11 (more specifically, neck portions 118 of sleeves 117 to be described later) are inserted into the pair of left and right wire engaging concave portions 96 and 97 of the wire holding member 68 from the upper side in the direction of length of the wire holding member 68, and the inserted state is held. In addition, the wire holding member 68 is put on the inner surface of the outer shell 21 in the region including the longitudinal opening and the vicinity thereof. In addition, a pair of upper and lower screws (not shown) are inserted into the screw insertion holes 86 and 87 of the wire holding member 68 and the screw insertion concave portions and the screw insertion holes of the outer shell 21 from the side of the wire holding member 68 and then threadably engaged and fixed in the boss portions 66 and 67 of the attachment base frame 61, respectively. At the same time, connection spherical ends 113 and 114 serving as connection convex portions provided at the proximal end sides of the wire main bodies 111 of the pair of left and right wires 11 engage with the pair of left and right engaging projecting portions 103 and 104 of the operation knob 9, respectively, so as to be connected to the guide member 62, as shown in FIGS. 7 and 9.

As shown in FIGS. 2 and 3, the wire connection mechanism 12 includes the first wire 11 connected to the left movable plate 32 to which the left end of the visor 5 is attached, and the second wire 11 connected to the right movable plate 32 to which the right end of the visor 5 is attached. Note that the first and second wires 11 can have a substantially same structure except that the lengths of the flexible wire main bodies 111 and flexible wire sheath portions 116 change between them. The wire main body 111 is inserted into the wire sheath portion 116 so as to be movable forward and backward substantially in the axial direction of the wire main body 111. The sleeves 117 made of a metal or the like are attached to the two proximal ends of the pair of wire sheath portions 116. The wire main body 111 extends through the sleeve 117 and projects from the sleeve 117. The connection spherical ends 46, 113 and 114 are attached to the distal ends of the projecting portions of the wire main bodies 111. The sleeves 117 have the neck portions 118 that engage with the wire connecting with concave portions 96 and 97 of the wire holding member 68. Note that the distal ends of the pair of wires 11 are also attached to the movable plates 32 on the left and right sides substantially similarly to the case of the proximal ends of the pair of wires 11, as shown in FIGS. 2 and 3.

4. Visor Attachment/Detachment Method

To attach the visor 5 to the helmet 1 by the visor attachment mechanism 8 on the left side, the attachment operation is performed in accordance with (a) to (c) to be described below.

(a) The helmet wearer or the like first moves, by a finger or the like, the knob main body 102 of the operation knob 9 of the operation knob attachment mechanism 10 shown in FIG. 3 forward obliquely upward from the lower side, thereby making the visor 5 pivot forward from the up position shown in FIG. 3 to the down position shown in FIGS. 1 and 2 about the attachment shaft portion 7 serving as the pivotal center, as will be described later in detail in "5. Visor Raising/Lowering Method". In this case, the movable plate 32 comes into contact with the second stopper 36 of the attachment board 31 so that the forward pivoting position of the movable plate 32 can be regulated.

(b) Next, the helmet wearer or the like faces the helmet 1 as needed and then inserts the region including the left end of the visor 5 and the vicinity thereof into the slit 41 of the left movable plate 32 obliquely from the lower side of the slit 41. At the time of insertion, the visor 5 is made to pivot upward from the lower side as the region including the left end of the visor 5 and the vicinity thereof is inserted into the slit 41 of the movable plate 32. In this pivotal movement upon insertion, the visor 5 pivots clockwise in FIG. 6 using, as a substantially pivotal center, the region including a corner portion 48*a* (in other words, concave corner portion) of the proximal end of the projecting portion 48 of the visor 5 on the side of a visor center line $L_1$ shown in FIG. 1 and the vicinity thereof, as shown in FIG. 6. Note that at the time of the pivotal movement, the region including the corner portion 48*a* and the vicinity thereof is preferably in contact with the region including a projecting portion 119 existing on the inlet side of the slit 41 and the vicinity thereof out of the boundary portion between the removal preventing hole portion 41*a* of the slit 41 of the movable plate 32 and the portion of the slit 41 other than the hole portion 41*a*.

(c) When the pivotal movement described in (b) at the time of insertion of the visor 5 has been done as described above, the axis of the engaging projecting portion 43 of the visor 5 moves in a substantially arc shape, as indicated by a chain line $L_2$ in FIG. 6. When the pivotal movement at the time of insertion of the visor 5 progresses to some degree, the distal end of the engaging projecting portion 43 comes into contact with the inner surface of the substantially triangular bent portion 53 of the outer wall portion 54 of the movable plate 32, as indicated by the chain line in FIG. 5. For this reason, the outer wall portion 54 is raised outward so as to be separated from the outer surface of the visor 5. Hence, the engaging projecting portion 43 engages with the engaging opening 44 while sliding on the inner surface of the substantially triangular bent portion 53 and the inner surface of the outer wall portion 54 outside the bent portion 53. In this engaged state, the region including the end of the visor 5 and the vicinity thereof is stored in the substantially whole slit 41, as shown in FIG. 4. The region including the end of the visor 5 and the vicinity thereof is prevented by the projecting portion 119 in contact with the corner portion 48*a* from pivoting clockwise in FIG. 4 using the engaging projecting portion 43 as the pivotal center. In addition, the region including the end of the visor 5 and the vicinity thereof is prevented by at least one of the upper end face in the region including the end of the visor 5 and the vicinity thereof (especially, out of the upper end face, the region including the end on the side opposite to the center line $L_1$ of the visor 5 and the vicinity thereof) and the side end face in the region including the end of the visor 5 and the vicinity thereof (especially, out of the side end face, the region including the end on the lower side and the vicinity thereof) from pivoting counterclockwise in FIG. 4 using the engaging projecting portion 43 as the pivotal center.

Performing the attachment operation described above in (a) to (c) allows to attach the left end of the visor 5 to the movable plate 32 of the visor attachment mechanism 8 on the left side. In addition, simultaneously performing the attachment operation described above in (a) to (c) for the right visor attachment mechanism allows to attach the right end of the visor 5 to the movable plate 32 of the visor attachment mechanism on the right side simultaneously. It is therefore possible to simultaneously attach the ends of the visor 5 on both the left and right sides to the movable plates 32 of the visor attachment mechanisms on both the left and right sides only by one pivotal movement described in (b) and (c) at the time of insertion of the visor 5. In this case, the ends of the visor 5 on both the left and right sides are inserted into and engage with the slits 41 of the movable plates 32 on both the left and right sides. In addition, the engaging projecting portions 43 and the engaging projecting portions 48 of the visor 5 on both the left and right sides engage with the engaging openings 44 and the removal preventing hole portions 41*a* of the movable plates 32 on both the left and right sides, respectively. Hence, the visor 5 can properly be attached to and held by the movable plates 32.

To detach the visor 5 from the visor attachment mechanism 8 on the left side (in other words, helmet 1), the detachment operation described in (d) and (e) is performed.

(d) First, the same operation as that described in (a) is performed to make the visor 5 pivot forward from the up position shown in FIG. 3 to the down position shown in FIGS. 1 and 2 about the attachment shaft portion 7 serving as the pivotal center.

(e) Next, the helmet wearer or the like faces the helmet 1 as needed and then raises the substantially triangular bent portion 53 outward from the visor 5 (in other words, upward in FIG. 5) by a finger or the like of the helmet wearer or the like. By this raise, the periphery of the engaging opening 44 in the inner surface of the outer wall portion 54 of the movable plate 32 moves forward up to or beyond the position facing the rounded distal end of the engaging projecting portion 43. Then, the visor 5 is made to pivot substantially in a direction reverse to that of the pivotal movement at the time of insertion described in (b) so as to remove the region including the left end of the visor 5 and the vicinity thereof from the slit 41 of the movable plate 32. In this case, the periphery of the engaging opening 44 comes into contact with the rounded portion of the engaging projecting portion 43 even if not completely disengaged from the engaging projecting portion 43. Hence, when the visor 5 pivots substantially in the direction reverse to that of the pivotal movement at the time of insertion, the rounded portion of the engaging projecting portion 43 raises the outer wall portion 54 outward. This enables to properly remove the region including the left end of the visor 5 and the vicinity thereof from the slit 41 of the movable plate 32.

Performing the detachment operation described above in (d) and (e) allows to detach the left end of the visor 5 from the movable plate 32 of the visor attachment mechanism 8 on the left side. In addition, simultaneously performing the detachment operation described above in (d) and (e) for the right visor attachment mechanism allows to detach the right end of the visor 5 from the movable plate 32 of the visor attachment mechanism on the right side simultaneously. It is therefore possible to simultaneously detach the ends of the visor 5 on both the left and right sides from the movable plates 32 of the visor attachment mechanisms on both the left and right sides only by one pivotal movement described in (e) at the time of detachment of the visor 5.

5. Visor Raising/Lowering Method

When the helmet 1 is in the visor up state shown in FIGS. 3 and 9, the engaging projecting portion 105 of the operation knob 9 engages with the engaging concave portion 85 of the guide member 62 so that the position of the engaging projecting portion 105 is held by the guide member 62, as shown in FIG. 8. To change the helmet 1 from the visor up state shown in FIGS. 3 and 9 to the visor down state shown in FIGS. 1, 2 and 7, the helmet wearer or the like holds the knob main body 102 of the operation knob 9 of the operation knob attachment mechanism 10 by fingers or the like, and moves the operation knob 9 forward obliquely upward substantially along the direction of length of the longitudinal opening 65 of the attachment base frame 61. In this case, since the engaging projecting portion 105 disengages from the engaging concave portion 85, the helmet wearer or the like can feel a click on his/her fingers or the like via the knob main body 102 at the time of disengagement. When the operation knob 9 moves forward, the wire main bodies 111 of the pair of wires 11 move forward from the backward position shown in FIG. 9 to the forward position shown in FIG. 7. In this case, since the engaging projecting portion 105 engages with the engaging concave portion 84, the helmet wearer or the like can feel a click on his/her fingers or the like via the knob main body 102 at the time of engagement.

The pair of wire main bodies 111 move forward to the forward position shown in FIGS. 2 and 7 and push the engaging projecting portions 45 of the pair of left and right movable plates 32 obliquely downward. For this reason, the pair of left and right movable plates 32 pivot forward substantially downward about the attachment shaft portions 7 serving as the pivotal centers. With the forward pivotal movement, the visor 5 pivots forward to the down position shown in FIGS. 1 and 2. Note that when the helmet 1 is in the visor down state shown in FIGS. 1, 2 and 7, the engaging projecting portion 105 of the operation knob 9 engages with the engaging concave portion 84 of the guide member 62 so that the position of the engaging projecting portion 105 is held by the guide member 62, substantially similarly as in the case shown in FIG. 8.

To change the helmet 1 from the visor down state shown in FIGS. 1, 2 and 7 to the visor up state shown in FIGS. 3 and 9, the helmet wearer or the like holds the knob main body 102 of the operation knob 9 of the operation knob attachment mechanism 10 by fingers or the like, and moves the operation knob 9 backward obliquely downward substantially along the direction of length of the longitudinal opening 65 of the attachment base frame 61. In this case, since the engaging projecting portion 105 disengages from the engaging concave portion 84, the helmet wearer or the like can feel a click on his/her fingers or the like via the knob main body 102 at the time of disengagement. When the operation knob 9 moves backward, the wire main bodies 111 of the pair of wires 11 move backward from the forward position shown in FIG. 7 to the backward position shown in FIG. 9. In this case, since the engaging projecting portion 105 engages with the engaging concave portion 85, the helmet wearer or the like can feel a click on his/her fingers or the like via the knob main body 102 at the time of engagement.

The pair of wire main bodies 111 move backward to the backward position shown in FIGS. 3 and 9 and pull the engaging projecting portions 45 of the pair of left and right movable plates 32 obliquely upward. For this reason, the pair of left and right movable plates 32 pivot backward substantially upward about the attachment shaft portions 7 serving as the pivotal centers. With the backward pivotal movement, the visor 5 pivots backward to the up position shown in FIG. 3. Note that when the helmet 1 is in the visor up state shown in FIGS. 3 and 9, the engaging projecting portion 105 of the operation knob 9 engages with the engaging concave portion 84 of the guide member 62 so that the position of the engaging projecting portion 105 is held by the guide member 62, substantially similarly as in the case shown in FIG. 8.

Having described a specific preferred embodiment of the present invention with reference to the accompanying drawings, it is to be understood that the present invention is not limited to that precise embodiment, and that various changes and modifications may be effected therein by one skilled in the art without departing from the scope or spirit of the invention as defined in the appended claims.

For example, in the above-described embodiment, the present invention is applied to a full-face-type helmet. However, the present invention is also applicable to a full-face-type helmet also usable as a jet-type helmet capable of raising the chin cover, a jet-type helmet, a semi-jet-type helmet, and the like.

Additionally, in the above-described embodiment, the concavoconvex engaging means configured to concavoconvex-engage the engaging projecting portion 43 provided on the visor 5 with the engaging opening 44 provided in the movable plate 32 is used as the first removal preventing means of the visor 5 for the movable plate 32. However, the engaging opening 44 need not always be a through hole and may be a simple engaging concave portion (in other words, blind hole). In addition to providing the engaging concave portion such as the engaging opening 44 in the visor 5, the engaging projecting portion 43 may be provided on the movable plate 32.

In the above-described embodiment, a rounded portion is added to the distal end of the engaging projecting portion 43 of the visor 5. However, in place of or in addition to the rounded portion at the distal end of the engaging projecting portion 43, a rounded portion (in other words, a rounded portion having a chamfered shape) may be added to the inner surface of the engaging opening 44 of the movable plate 32.

In the above-described embodiment, out of the slit 41 of the movable plate 32, only the side of the center line $L_1$ of the visor 5 (in other words, only the insertion side of the region including the end of the visor 5 and the vicinity thereof) is open to the outside. However, one or some of the upper wall portion 49*a*, the side wall portion 49*b* on the far side and the lower wall portion 49*c* may partially or wholly be omitted (in other words, communicate with the outside). The side wall portion 49*d* on the inlet side may also partially be omitted (in other words, communicate with the outside).

In the above-described embodiment, the movable plate 32 pivots forward and backward about the attachment shaft portions 7 serving as the pivotal center and thus lowers and rises. However, the movable plate 32 need not pivot forward and backward about a specific pivotal center and may be configured to move forward and backward between the up position and the down position along another arbitrary moving locus.

The invention claimed is:

1. A visor attachment mechanism in a helmet, wherein the helmet comprises:

a head protecting body having a window opening formed in a front surface; and a visor attached to said head protecting body to be movable forward and backward with respect to said head protecting body so as to at least partially open or at least partially close the window opening;

the visor attachment mechanism comprising:

a movable plate attached to said head protecting body to be movable forward and backward so as to indirectly attach said visor to said head protecting body via said movable plate;

a slit provided in said movable plate to extend substantially in a planar direction of said movable plate so as to receive a region including one of a left end and a right end of said visor and a vicinity thereof, wherein said movable plate further comprises, around said slit, an upper wall portion, a first side wall portion located on a side opposite to an insertion side of said visor to said slit, a lower wall portion, and a second side wall portion located on a lower end on the insertion side of said visor to said slit; and removal preventing means for preventing the region including one of the left end and the right end of said visor and the vicinity thereof from being removed from said slit, wherein said removal preventing means comprises first removal preventing means and second removal preventing means, said first removal preventing means comprises:

an engaging projecting portion provided on one of said movable plate and the region including one of the left end and the right end of said visor and the vicinity thereof so as to project in a direction substantially perpendicular to the planar direction of one of said visor and said movable plate; and an engaging concave portion provided in one of said movable plate and the region including one of the left end and the right end of said visor and the vicinity thereof so as to engage with said engaging projecting portion when the region including one of the left end and the right end of said visor and the vicinity thereof is inserted into said slit; and said second removal preventing means comprises:

a removal preventing projecting portion is provided in the region including one of the left end and the right end and the vicinity thereof of said visor, said removal preventing projecting portion further comprising a concave corner portion, wherein said removal preventing projecting portion and said concave corner portion extend substantially in a planar direction of the visor substantially toward the downward direction in the region including one of the left end and the right end of said visor and the vicinity thereof;

a first position regulating portion formed from an upper end and a vicinity thereof of said second side wall portion of said movable plate to come into contact with said concave corner portion and impede pivotal movement in a first direction out of the pivotal movement of said visor with respect to said movable plate about one of said engaging projecting portion and said engaging concave portion; and a second position regulating portion formed from at least one of said upper wall portion and said first side wall portion of said movable plate to come into contact with the region including one of the left end and the right end of said visor and the vicinity thereof and impede pivotal movement in a second direction out of the pivotal movement of said visor.

2. The visor attachment mechanism according to claim 1, wherein said helmet is a full-face-type helmet.

3. The visor attachment mechanism according to claim 1, wherein said visor is a sun visor.

4. The visor attachment mechanism according to claim 1, wherein said movable plate is attached to said head protecting body via axial support means so as to pivot forward and backward.

5. The visor attachment mechanism according to claim 1, wherein said engaging concave portion is a through hole.

6. The visor attachment mechanism according to claim 1, wherein said engaging projecting portion is provided in the region including one of the left end and the right end of said visor and the vicinity thereof, and said engaging concave portion is provided in said movable plate.

7. The visor attachment mechanism according to claim 1, further comprising:

a bent portion formed by a corner portion of an outer wall portion of said movable plate, wherein said bent portion is configured to tilt outward from a proximal end of said bent portion to a distal end of said bent portion at least on an inner surface of said outer wall portion, and said engaging concave portion is configured to relatively and at least partially rise from said engaging projecting portion when said bent portion is raised outward.

8. The visor attachment mechanism according to claim 7, wherein said bent portion has a substantially triangular shape, and a thickness of said bent portion gradually decreases from the proximal end to the distal end substantially continuously.

9. The visor attachment mechanism according to claim 7, wherein an angle made by an inner surface of said bent portion and an outer surface of said visor falls within a range of 11.5° to 22.5° .

10. The visor attachment mechanism according to claim 7, wherein an angle made by an inner surface of said bent portion and an outer surface of said visor falls within a range of 12° to 22° .

11. The visor attachment mechanism according to claim 7, wherein an area of the inner surface of said bent portion falls within a range of 12 to 24 $mm^2$.

12. The visor attachment mechanism according to claim 7, wherein an area of the inner surface of said bent portion falls within a range of 14 to 22 $mm^2$.

13. The visor attachment mechanism according to claim 7, wherein a distance between an inner surface of said bent portion and an inner end of the distal end of said bent portion rising from the inner surface falls within a range of 0.8 to 1.6 mm.

14. The visor attachment mechanism according to claim 7, wherein a distance between an inner surface of said bent portion and an inner end of the distal end of said bent portion rising from the inner surface falls within a range of 0.9 to 1.5 mm.

15. The visor attachment mechanism according to claim 1, wherein the visor attachment mechanism is configured to move said movable plate forward and backward via a wire connection mechanism by moving an operation knob of an operation knob attachment mechanism forward and backward, said operation knob attachment mechanism comprises an attachment base attached to an outer surface of said head protecting body, a longitudinal guide member attached to an inner surface of said attachment base, and said operation knob attached to said longitudinal guide member to be movable forward and backward, said operation knob comprises a base portion and a knob main body formed into a roof shape on said base portion, and said operation knob is attached to said longitudinal guide member to be slidable forward and backward with respect to said longitudinal guide member by relatively inserting said longitudinal guide member between said base portion of said operation knob and said knob main body of said operation knob.

16. The visor attachment mechanism according to claim 15, wherein said operation knob attachment mechanism comprises a wire holding member attached to said attachment base so as to locate on an inner surface of said longitudinal guide member, said wire holding member being configured to hold a position of a wire sheath portion of said wire connection mechanism.

17. The visor attachment mechanism according to claim 15, wherein said operation knob further comprises an engaging projecting portion, and said longitudinal guide member comprises a first engaging concave portion that engages with said engaging projecting portion by clicking with said engaging projecting portion when said operation knob moves backward, and a second engaging concave portion that engages with said engaging projecting portion by clicking with said engaging projection portion when said operation knob moves forward.

* * * * *